US009845997B2

(12) United States Patent
Neumann et al.

(10) Patent No.: US 9,845,997 B2
(45) Date of Patent: Dec. 19, 2017

(54) HEAT EXCHANGER

(71) Applicant: BEHR GMBH & CO. KG, Stuttgart (DE)

(72) Inventors: Emil Neumann, Stuttgart (DE); Falk Viehrig, Sindelfingen (DE); Wolfgang Seewald, Tamm (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 245 days.

(21) Appl. No.: 14/369,057

(22) PCT Filed: Dec. 21, 2012

(86) PCT No.: PCT/EP2012/076852

§ 371 (c)(1),
(2) Date: Jun. 26, 2014

(87) PCT Pub. No.: WO2013/098274

PCT Pub. Date: Jul. 4, 2013

(65) Prior Publication Data

US 2014/0352936 A1 Dec. 4, 2014

(30) Foreign Application Priority Data

Dec. 30, 2011 (DE) ..... 10 2011 090 176

(51) Int. Cl.
*F28D 9/00* (2006.01)
*F28D 1/03* (2006.01)
(Continued)

(52) U.S. Cl.
CPC ..... *F28D 9/0062* (2013.01); *F28D 1/0333* (2013.01); *F28D 1/0426* (2013.01);
(Continued)

(58) Field of Classification Search
CPC .... F28D 1/0341; F28D 1/0333; F28D 1/0435; F28D 1/05383; F28D 1/0426; F28D 20/02; F28D 9/00062
(Continued)

(56) References Cited

U.S. PATENT DOCUMENTS 3,258,832 A * 7/1966 Gerstung ..... B21D 53/04 165/148
3,292,690 A 12/1966 Donaldson
(Continued)

FOREIGN PATENT DOCUMENTS

DE 19 08 800 A 1/1970
DE 35 36 325 A1 5/1986
(Continued)

OTHER PUBLICATIONS

International Search Report, PCT/EP2012/076852, dated Mar. 28, 2013, 2 pgs.
(Continued)

*Primary Examiner* — Jianying Atkisson
*Assistant Examiner* — Raheena R Malik
(74) *Attorney, Agent, or Firm* — Paul D. Strain, Esq.; Strain & Strain PLLC

(57) ABSTRACT

A plate-type heat exchanger, in particular for motor vehicles, is described which includes plate pairs. In one example, a plate pair includes a first plate and a second plate that form a first flow path and a second flow path between the plates. In this configuration, the first and the second plate are associated with a first attachment plate and a second attachment plate, respectively. A third flow path is formed between the first plate and the second attachment plate and the first flow path is formed between the second plate and the first attachment plate. Alternatively, the third flow path is formed between the first plate and the first attachment plate and the
(Continued)

first flow path is formed between the second plate and the second attachment plate. A spatial region for a fourth flow path may also be formed between adjacent plate pairs.

8 Claims, 6 Drawing Sheets

(51) Int. Cl.
*F28D 1/04* (2006.01)
*F28D 21/00* (2006.01)
*F28D 20/00* (2006.01)

(52) U.S. Cl.
CPC ..... *F28D 2020/0008* (2013.01); *F28D 2020/0013* (2013.01); *F28D 2021/0085* (2013.01)

(58) Field of Classification Search
USPC ..... 165/153, 166
See application file for complete search history.

(56) References Cited

U.S. PATENT DOCUMENTS 3,631,923 A * 1/1972 Izeki ..... F28B 1/02 165/167
4,327,802 A * 5/1982 Beldam ..... F28D 1/0333 165/153
4,712,612 A 12/1987 Okamoto et al.
5,024,269 A * 6/1991 Noguchi ..... F28D 1/0341 165/153
5,137,082 A * 8/1992 Shimoya ..... F25B 39/022 165/110
5,503,223 A * 4/1996 Choi ..... F28D 1/0341 165/153
5,507,338 A * 4/1996 Schornhorst ..... F28D 1/0333 165/153
5,855,240 A * 1/1999 Farrell ..... F28D 1/0341 165/152
5,937,935 A * 8/1999 Schornhorst ..... B21D 53/04 165/153
6,269,869 B1 * 8/2001 Tavi ..... F28D 1/0333 165/153
6,438,840 B2 8/2002 Tavi et al.
6,854,513 B2 2/2005 Shirota et al.
6,973,804 B2 * 12/2005 Horiuchi ..... F25B 39/022 165/110
8,495,894 B2 7/2013 Kerler et al.
2002/0124999 A1 * 9/2002 Chiba ..... F28D 1/0333 165/153
2002/0195237 A1 * 12/2002 Luz ..... F28D 9/0043 165/153
2004/0011514 A1 * 1/2004 Holm ..... F28D 9/005 165/166
2005/0144978 A1 * 7/2005 Papapanu ..... F28D 1/0333 62/515
2006/0266501 A1 11/2006 So et al.
2007/0039714 A1 * 2/2007 Loup ..... B60H 1/005 165/43
2007/0295026 A1 12/2007 Mori et al.
2009/0120624 A1 * 5/2009 Lim ..... F28D 1/0333 165/158
2014/0374074 A1 12/2014 Seewald

FOREIGN PATENT DOCUMENTS

DE 101 24 757 A1 11/2001
DE 10 2006 028 017 A1 8/2007
DE 10 2008 045 845 A1 3/2010
FR 2 866 947 A1 9/2005
FR 2 918 166 A1 1/2009
JP S62-293086 A 12/1987
JP H11-153395 A 6/1999
JP 2000-205777 A 7/2000
KR 2007-0067848 A 6/2007
WO WO 2006/059005 A1 6/2006
WO WO 2010/150774 A1 12/2010

OTHER PUBLICATIONS

German Search Report, DE 10 2011 090 176.0, dated Aug. 8, 2012, 5 pgs.
German Search Report, DE 10 2011 090 188.4, dated Aug. 6, 2012, 5 pgs.
International Search Report, PCT/EP2012/076858, dated May 14, 2013, 3 pgs.
Seewald, U.S. PTO Office Action, U.S. Appl. No. 14/369,104, dated May 17, 2016, 11 pgs.
Seewald, U.S. PTO Office Action, U.S. Appl. No. 14/369,104, dated Nov. 15, 2016, 10 pgs.
Seewald, U.S. PTO Advisory Action, U.S. Appl. No. 14/369,104, dated Jan. 13, 2017, 5 pgs.
Seewald, U.S. PTO Office Action, U.S. Appl. No. 14/369,104, dated Mar. 7, 2017, 10 pgs.
Seewald, U.S. PTO Office Action, U.S. Appl. No. 14/369,104, dated Sep. 28, 2017, 6 pgs.

* cited by examiner

HEAT EXCHANGER

CROSS-REFERENCE TO RELATED PATENT APPLICATIONS

This application is a National Stage of International Application No. PCT/EP2012/076852, filed Dec. 21, 2012, which is based upon and claims the benefit of priority from prior German Patent Application No. 10 2011 090 176.0, filed Dec. 30, 2011, the entire contents of all of which are incorporated herein by reference in their entirety.

TECHNICAL FIELD

The invention relates to a plate-type heat exchanger, in particular for motor vehicles, having a multiplicity of plate groups for forming first and second and third flow paths, wherein a space region for fourth flow paths is formed between adjacent plate groups.

PRIOR ART

Heat exchangers are provided in motor vehicles in large numbers and for a wide variety of purposes. Accordingly, in air-conditioning systems, evaporators are used for the purpose of cooling air, which flows through flow paths through the evaporator, by the evaporation of the refrigerant in flow paths in the evaporator, in order thereby to realize air conditioning and dehumidification in the vehicle interior. Flat-tube evaporators or plate-type evaporators have become known for this purpose.

In motor vehicles, the major trend in recent times has been to reduce the fuel consumption of a motor vehicle and the associated $CO_2$ emissions. This is achieved, in the case of motor vehicles with an internal combustion engine, inter alia by virtue of the internal combustion engine of the vehicle being shut down in temporary standstill situations, which arise for example as a result of the vehicle stopping at a traffic signal or in similar situations. When the vehicle is reactivated, by actuation of the accelerator pedal or the clutch pedal, for the purpose of driving away, the internal combustion engine is automatically reactivated. This technology is also referred to as the start-stop method. Such start-stop methods are already used in fuel-efficient motor vehicles. In the case of motor vehicle air-conditioning systems that are conventional on the market, with a refrigeration circuit based on the cold vapor process, the compressor of the refrigerant circuit is generally driven by way of a belt drive which is driven by the motor vehicle drive engine. When the engine is at a standstill, it is thus the case that, with the compressor drive at a standstill, the air-conditioning system can no longer be regarded as working so as to produce a refrigeration effect. When the engine is shut down in the start-stop mode, it is thus no longer possible for the air-conditioning system of the motor vehicle to operate and provide the refrigeration power for the cooling of the vehicle interior. As a consequence of this situation, the evaporator of the air-conditioning system warms up relatively quickly, and the air flowing through the evaporator is cooled only to a small extent or to an insufficient extent. This firstly has the effect that the vehicle interior temperature rises, adversely affecting the comfort of the vehicle occupants.

In the case of a motor vehicle air-conditioning system, not only the temperature reduction but also a dehumidification process takes place, because the air moisture present in the air is condensed at the evaporator and emerges from the vehicle through a condensate outlet. The air flowing through the evaporator is thus dehumidified and enters, having been dehumidified, into the vehicle interior. When a start-stop mode is active, this also has the effect that the dehumidification of the air entering into the vehicle interior can no longer be adequately ensured, such that the air moisture in the vehicle interior rises when the start-stop mode is active. This also leads to an increase in air moisture that is perceived by the vehicle occupants to be unpleasant and uncomfortable.

To prevent or slow these processes that lead to an increase in temperature and air humidity, the so-called accumulator-type evaporator has been developed which, aside from the actual evaporator function, also comprises a cold accumulator medium which extracts heat from, and continues to cool and dehumidify, the air that flows through the evaporator when the start-stop mode is active.

Said accumulator-type evaporators are known for example from DE 102006028017. Here, the accumulator-type evaporator disclosed in said document is composed of two separate heat exchanger blocks, the evaporator and the accumulator part, which are produced in different production processes and which are connected to one another only a short time before the brazing process, and which subsequently jointly undergo brazing to form a unit. Here, the main evaporator is composed of two flat-tube rows which are arranged one behind the other in the air direction, and the accumulator part is positioned downstream of said two flat-tube rows in the air direction. The accumulator part is in this case composed of double-tube rows in which two tubes are plugged one inside the other, wherein the refrigerant flows through the interior of the inner tube and the cold accumulator medium is arranged in the intermediate space between the outer tube and inner tube. The production process for this is cumbersome and expensive because numerous different parts have to be coordinated with one another, joined and calibrated in order to be able to produce a functional heat exchanger. In particular, the double tube with concealed tube inlets has proven to be relatively complex, the number of parts very high, with a simultaneously high number of different parts, and adhering to tolerances poses a risk to process capability owing to the multiplicity of components. This conversely entails increased risk of leakage, such that, aside from the part costs, there is also the risk of an increased rejection rate.

PRESENTATION OF THE INVENTION, PROBLEM, SOLUTION, ADVANTAGES

It is the object of the invention to provide a heat exchanger which is simple to produce and which entails lower costs than the heat exchangers known from the prior art, while simultaneously being of reduced complexity and resulting in a reduced rejection rate.

This is achieved by means of a heat exchanger having the features of claim 1, according to which there is provided a plate-type heat exchanger, in particular for motor vehicles, having a multiplicity of plate pairs for forming first, second and third flow paths, wherein a space region for fourth flow paths is formed between adjacent plate pairs, and a plate pair is formed from at least one first plate and one second plate in order to form the first flow path and the second flow path between the first and the second plate, wherein the first and the second plate are assigned a first attachment plate and a second attachment plate, respectively, wherein the third flow path is formed between the first plate and the second attachment plate which is placed onto the first plate, and the first flow path is furthermore formed between the second plate and the first attachment plate which is placed onto the first plate, or the third flow path is formed between the first plate and the first attachment plate which is placed onto the first plate, and the first flow path is furthermore formed between the second plate and the second attachment plate which is placed onto the second plate.

It is advantageous here if the first plate and the second plate and the first and the second attachment plates have openings and/or cups as port and connecting regions, and have duct-forming structures such as embossments for forming at least one flow path between port regions.

It is also advantageous if the first plate and the second plate of the plate pair have, at two opposite end regions, in each case three port and connecting regions for the first, the second and the third flow path, wherein at least one duct-forming structure is provided between two opposite port regions in order to form the first or the second flow path.

It is furthermore advantageous if the first attachment plate and the second attachment plate of the plate pair have, at two opposite end regions, in each case two port and connecting regions for two of the first, second or third flow paths, wherein at least one duct-forming structure is provided between two opposite port regions in order to form the first or the third flow path.

It is also expedient if the first plate and the second plate have a region which can be provided with an attachment plate for the purpose of forming a duct-forming structure between in each case two port regions in order to form the first or the third flow path.

Here, it is also expedient if the duct-forming structures are embossed, in the form of a protruding duct, into the first plate and/or into the second plate and into the first attachment plate and into the second attachment plate.

It is furthermore expedient if the first attachment plate has a duct-forming structure between the port regions for the first flow path.

It is also advantageous if the second attachment plate has a duct-forming structure between the port regions for the second flow path.

In one development of the invention, it is expedient if the first attachment plate is formed in one piece with the first plate.

It is also advantageous if the second attachment plate is formed in one piece with the second plate.

It is furthermore advantageous if the first attachment plate is produced together with the first plate and the second attachment plate is produced together with the second plate, and said first attachment plate and second attachment plate can then in each case be placed onto a planar region of the first and second plate, respectively, by means of a bending process.

It is also advantageous if the first and/or the second attachment plate are/is formed separately from the first plate or from the second plate and can be placed onto a planar region of the first or second plate.

Further advantageous refinements are described in the following description of the figures and in the subclaims.

BRIEF DESCRIPTION OF THE DRAWINGS

The invention will be explained in more detail below on the basis of a least one exemplary embodiment and with reference to the drawings, in which.

PREFERRED EMBODIMENT OF THE INVENTION

Figure 1:
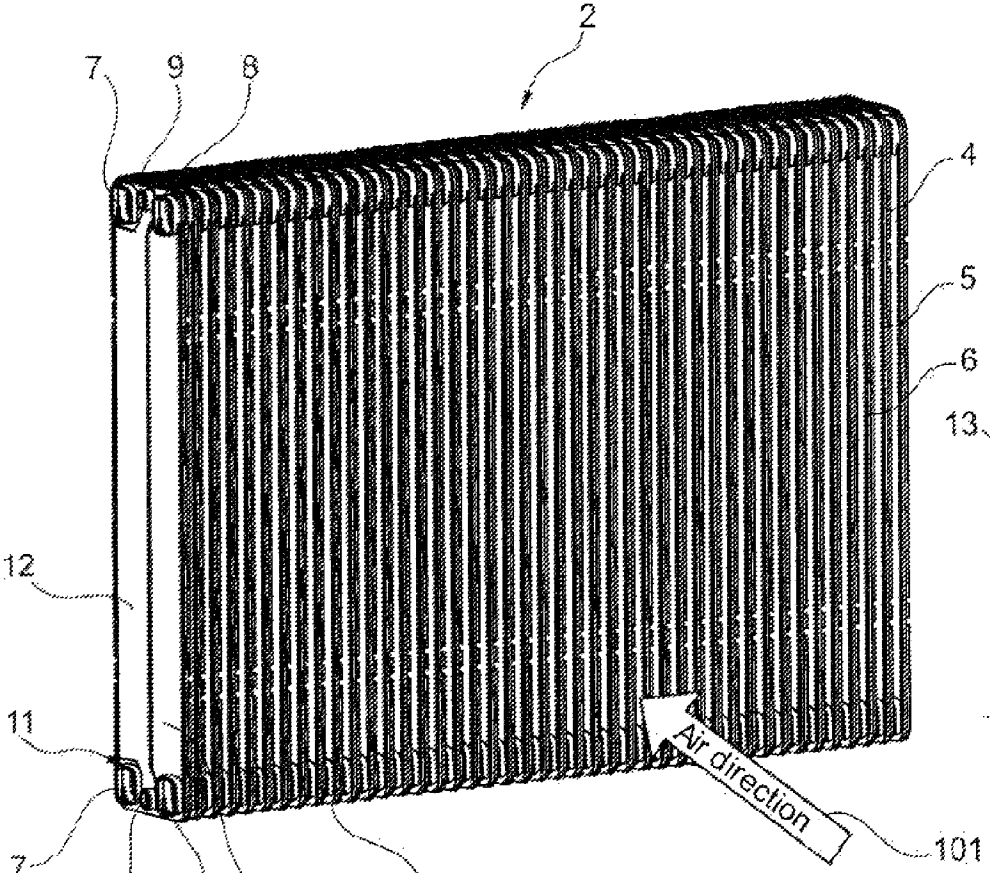
FIG. 1 shows a first exemplary embodiment of a heat exchanger according to the invention.

FIG. 1 shows a heat exchanger 1 which is formed with a first, upper collector 2 and a lower second collector which are formed on opposite end regions of the heat exchanger and which extend in the transverse direction of the heat exchanger. Between the two collectors there is provided a block 4 which is composed of a network of plates, wherein the plates are joined together to form plate groups 5, and space regions 6 are provided in each case between adjacent plate groups, which space regions are provided for a throughflow of air. The air flowing through said space regions is denoted by the arrow 101.

As can be seen, the upper and the lower collector 2, 3 are formed from substantially three flow ducts which are formed by the three port connectors or port regions 7, 8 and 9, wherein the port connectors in the plates of the plate pairs are preferably configured as openings and/or as cups, that is to say as embossments perpendicular to the plate plane. If two adjacent plate pairs now make contact, they make contact in the region of the cups, such that the cups, considered on their own, form a flow duct in the lateral direction of the heat exchanger. Between the collectors there are also provided flow ducts which extend between the port regions in the manner of cups. Here, the first, second and third flow ducts 10, 11, 12 are provided, wherein the flow ducts 10 are formed between the port regions 8, the flow ducts 11 are formed between the port regions 7 and the flow ducts 12 are formed between the port regions 9.

Figure 2:
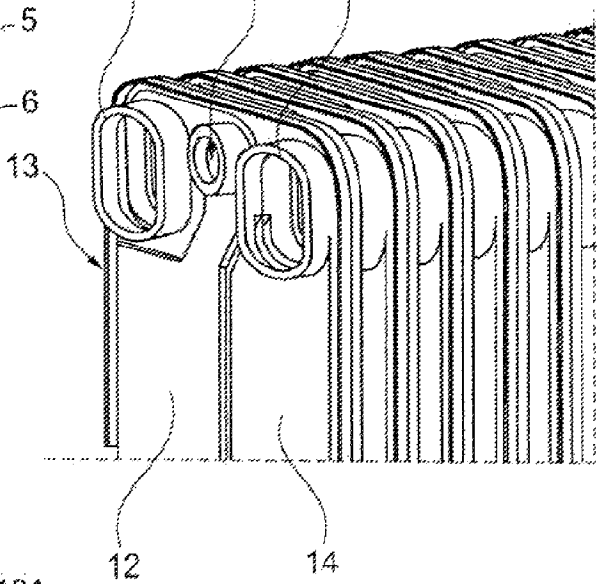
FIG. 2 shows a view of an enlarged detail of FIG. 1.

FIG. 2 shows a detail of the heat exchanger, in which it can be seen that the plate pairs have three adjacently arranged cups for connecting to the three flow ducts 10, 11, 12, wherein the port 9 communicates with the flow duct 12 and is formed as an attachment plate. Here, the two ports 7, 9 are formed by the attachment plate 13, which is placed onto the plate 14 with the port 8.

Figure 3:
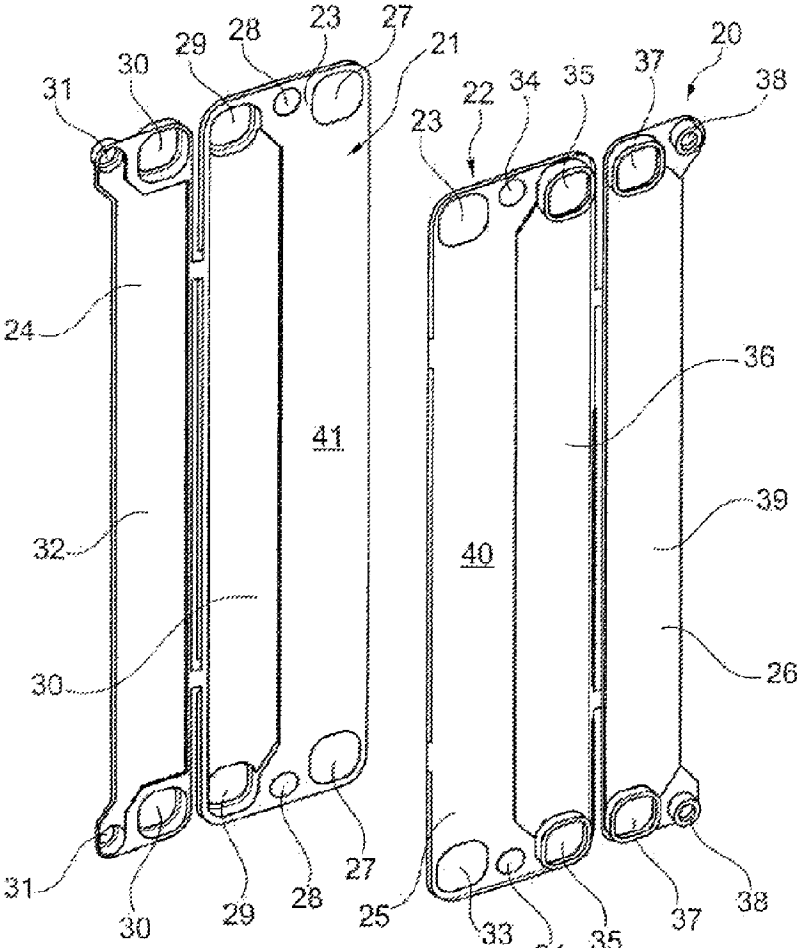
FIG. 3 shows a view of a plate arrangement of a heat exchanger.

FIG. 3 shows the plate pair 20, which is formed in two parts and is composed of a first plate 21 and of a second plate 22. Here, the plate 21 is composed of a main plate 23 and an attachment plate 24, wherein the plate 22 is composed of a main plate 25 and an attachment plate 26. As can be seen, the main plate 23 has, at the two opposite end regions, in each case three fluid ports 27, 28 and 29, wherein only the port 29 is formed as a protruding cup, and a flow duct 42 is embossed into the main plate 23 only between said two cups 29. No fluid ducts are embossed into the main plate 23 between the openings 27 and 28 respectively. In turn, the attachment plate that is connected to the main plate has, at both the upper and lower end regions, two ports which are embossed as cups and which are of protruding form, wherein the cups 30 are formed into the attachment plate without having a fluid duct formed between them. The ports 31, which are embossed in the manner of cups, have a fluid duct which is denoted by 32 and which, in principle, covers the entire width of the attachment plate, wherein a narrowing of the fluid duct is provided in the region close to the port in order that said fluid duct does not collide with the port 30. The plate 22 is of similar form, wherein the plate 22 in turn has openings 33, 34 and 35 at both the upper and lower end regions, wherein it is in turn also the case here that only the openings 35 are formed or embossed in the manner of cups and a fluid duct 36 is embossed into the plate between said cup-like port regions. The openings or ports 33 and 34 are not embossed as cups, and also do not have a fluid-duct-like connection between them.

Adjacent to the main plate 25 there is in turn provided an attachment plate 26 which is connected to the main plate, wherein the attachment plate 26 in turn has port regions 37 and 38 at its two upper and lower end regions, wherein said two port regions 37 and 38 are in turn embossed in the manner of cups, wherein, in the exemplary embodiment of said plate, the cups 37 are connected to a fluid duct 39, wherein the embossments 38 do not communicate with the fluid duct 39.

To produce a plate pair, the two plate main regions 23 and 25 are then placed onto one another such that the openings 29 are in alignment with the openings 33, the openings 28 are in alignment with the openings 34, and the openings 27 are in alignment with the openings 35. In this way, the planar region 40 laterally covers the fluid duct 42, and the planar region 41 laterally covers the fluid duct 36. The attachment regions 24 are subsequently folded over onto the region 40, and the attachment plate 26 is folded over onto the region 41, such that a total of four separate fluid ducts are formed, wherein the fluid duct 42 is covered by the surface region 40 and the fluid duct 32 is placed thereon. Since the cups 30 and 31, and the openings 29 and 28, respectively, are not in fluid communication with one another, it is correspondingly the case that two adjacent flow ducts 42 and 32 are formed which do not communicate with one another. At the same time, the fluid duct 36 is formed by virtue of its being covered by the surface region 41, and the fluid duct 39 is likewise covered by the surface 41, wherein in this case, however, the two cups 35 and 37 communicate with one another via the opening 27, such that the fluid ducts 36 and 39 are connected fluidically and in parallel. The port 38 communicates, by way of the opening 28, with the opening 34 and with the cup 31, and is thus connected to the fluid duct 32.

Overall, FIG. 3 thus shows the form of a plate pair in which two plates are used, with main plates and attachment plates, wherein, by virtue of the main plates being placed onto one another and the attachment plates being respectively folded over onto a planar region of the adjacent main plate, a total of four flow ducts are formed, of which, however, two are connected fluidically in parallel, such that a total of three fluid ducts are provided to which a feed can be provided through the three port regions at the end regions of the plate pairs.

Figures 4, 5, 6:
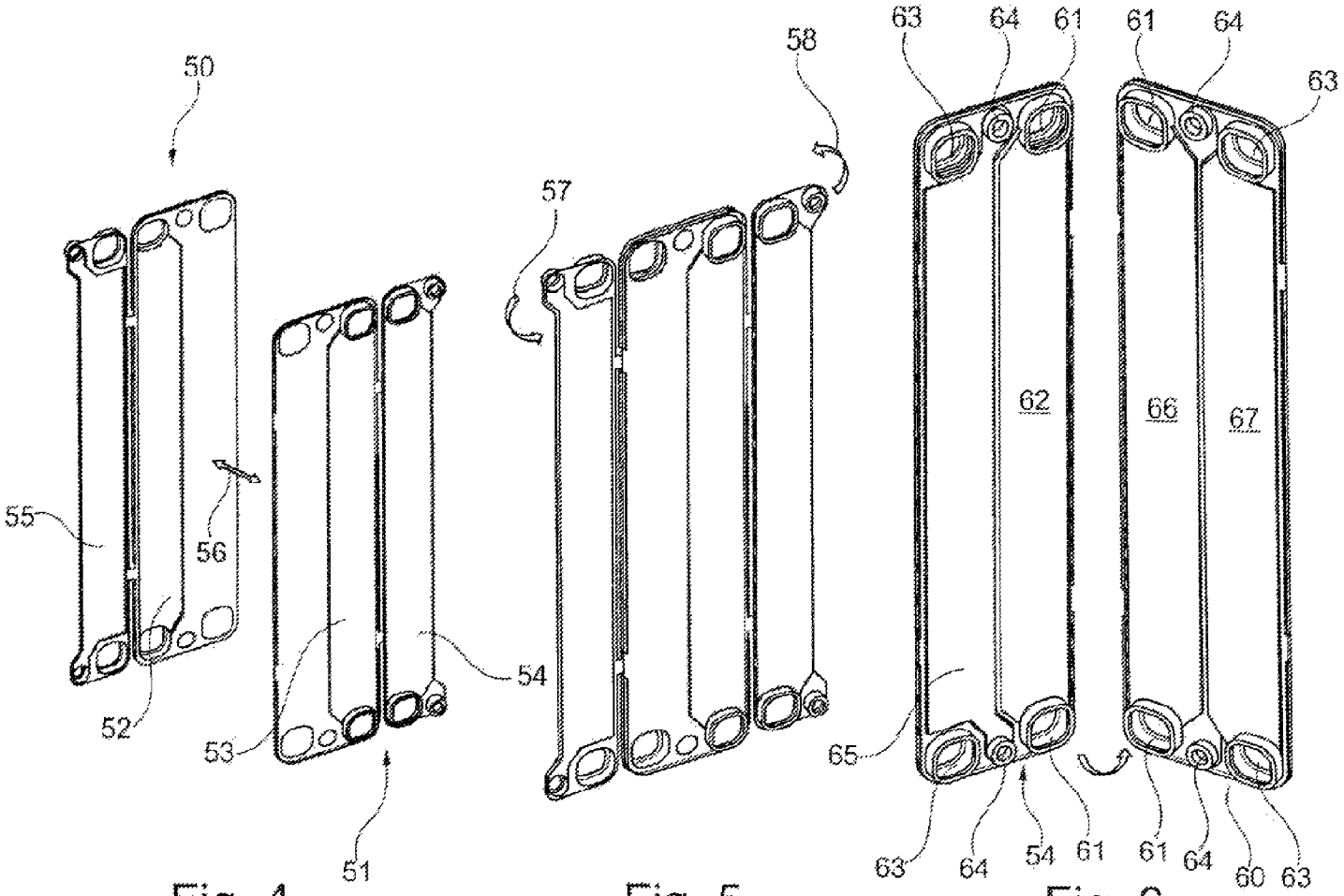
FIG. 4 shows a view of a plate arrangement of a heat exchanger.
FIG. 5 shows a view of a plate arrangement of a heat exchanger.
FIG. 6 shows a view of a plate arrangement of a heat exchanger.

FIGS. 4 to 6 show this process again in schematic form. FIG. 4 shows that, in the two plates 50, 51, there are provided three fluid or refrigerant ducts which are denoted by 52, 53 and 54, wherein a further duct or cold accumulator duct is also provided, this being denoted by 55. Four ducts are thus shown. By virtue of the main plates being placed onto one another, in this regard see the arrow 56 in FIG. 4 and FIG. 5, in which the two main plates have already been placed onto one another, the respective attachment plate is subsequently placed onto the planar surface of the adjacent main plate by virtue of the attachment plates being folded over. This is indicated by the arrows 57, 58 in FIG. 5. It can be seen in FIG. 6 that said attachment plates have already been folded over and form a plate pair.

FIG. 6 shows two plate pairs, each from a different side, wherein it can be seen that the plate 59 has a fluid duct 62 which communicates with a large port opening 61, and the fluid duct 62 is thus a refrigerant fluid duct in the event that refrigerant flows through said port 61. The port 63 is likewise connected to a fluid duct, though this cannot be seen in the view of this side. It can also be seen that the ports 64 are fluidically connected to the fluid duct 65. The opposite side of the plate 60 shows that the ports 61 are connected to the fluid duct 66, the ports 63 are connected to the fluid duct 67, and the ports 64 are not connected to a fluid duct that can be seen on this side.

Figure 7:
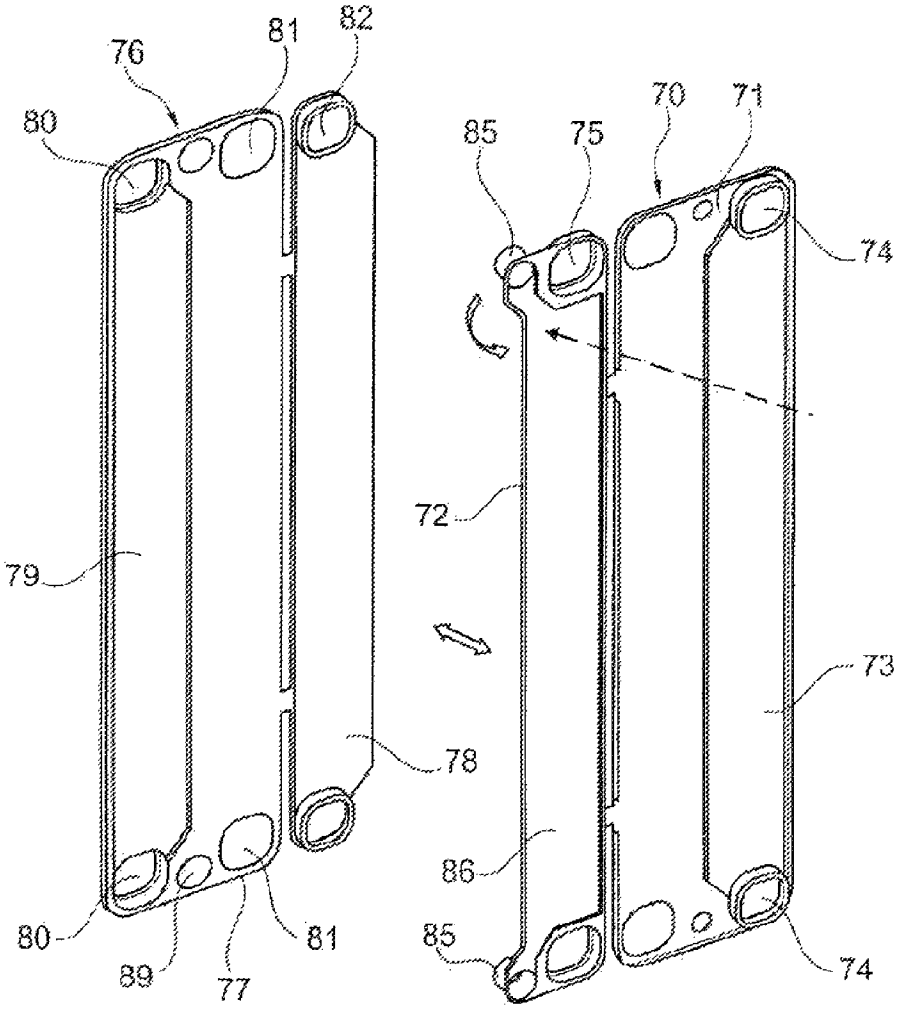
FIG. 7 shows a view of a plate arrangement of a heat exchanger.

FIG. 7 shows an alternative exemplary embodiment in this regard, in which the structure of the plates as per FIG. 3 is substantially maintained, wherein the main difference between the exemplary embodiments of FIGS. 3 and 7 lies in the interchanged arrangement of the fluid ducts in the main plates in relation to the attachment plate. Accordingly, it can be seen that FIG. 7 shows a plate 70 which has a main plate 71 and an attachment plate 72. The attachment plate 72 corresponds to the attachment plate 24 as per FIG. 3, wherein the main plate 71 has been modified in relation to the main plate 23 such that the fluid duct 73 is now arranged not between the openings 29 adjacent to the attachment plate but rather between the ports 74 which are arranged at that end of the plate which is remote from the attachment plate, and furthermore, the cups 74 are embossed in the opposite direction to the cups 75 of the attachment plate.

The same substantially applies to the plate 76, which has a main plate 77 and an attachment plate 78, wherein it is in turn also the case here that the main plate 77 has a fluid duct 79 between ports 80, and the openings 81 arranged adjacent to the remote end of the plate are not provided with a fluid duct. It can also be seen that the cups of the ports of the attachment plate are in turn embossed in a different direction than the cups 80 of the main plate 77. It can also be seen that the attachment plate 78 only has an embossment at its respective ends and has the embossment.

When the two plates 70 and 76 are mounted on one another, that is to say the main plates are placed onto one another, and the attachment plates are subsequently folded over, said attachment plates are placed not onto the adjacent plate but rather onto the plate to which they are connected. This can also be seen in FIGS. 8 and 9.

Figure 8:
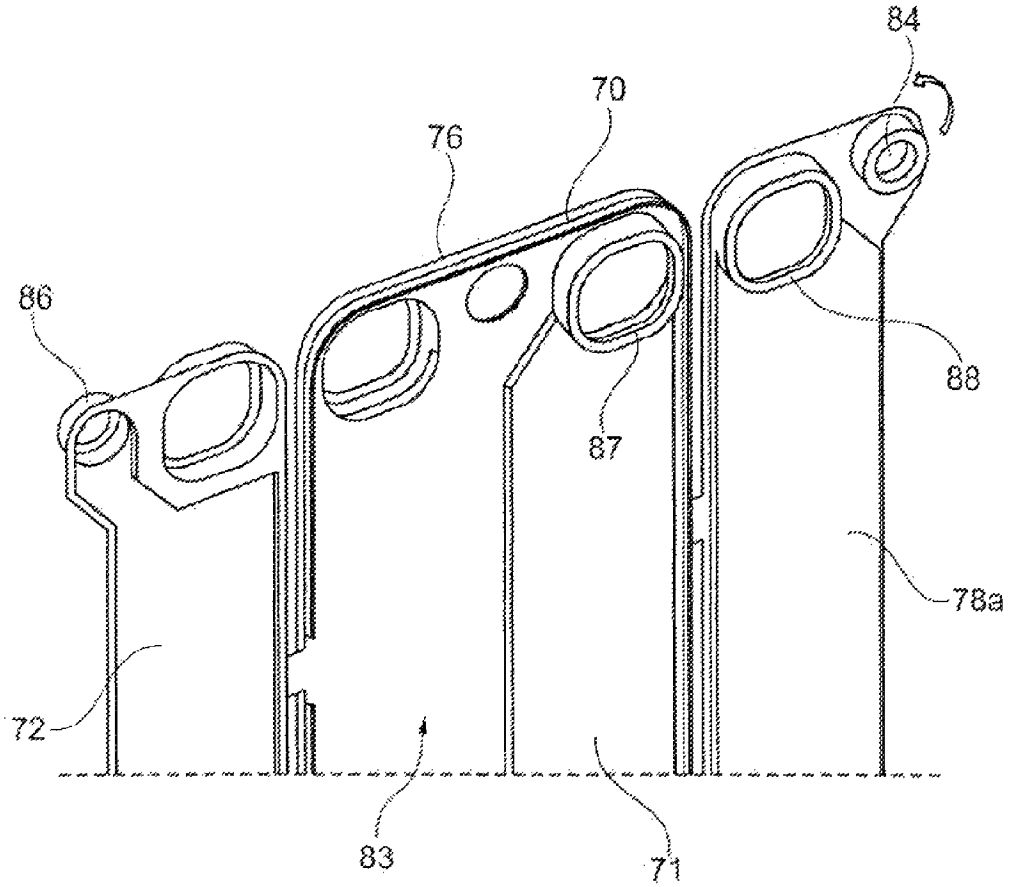
FIG. 8 shows a view of a plate arrangement of a heat exchanger in a detail view.

FIG. 8 shows the arrangement of the plates 70 and 76 such that the two main plates 71 and 77 have been placed onto one another. The attachment plate 72 is subsequently placed onto the planar region 83 of the plate 71, wherein, subsequently, the attachment plate **78*a* is placed onto the planar region (not visible) of the plate 76**.

Figure 9:
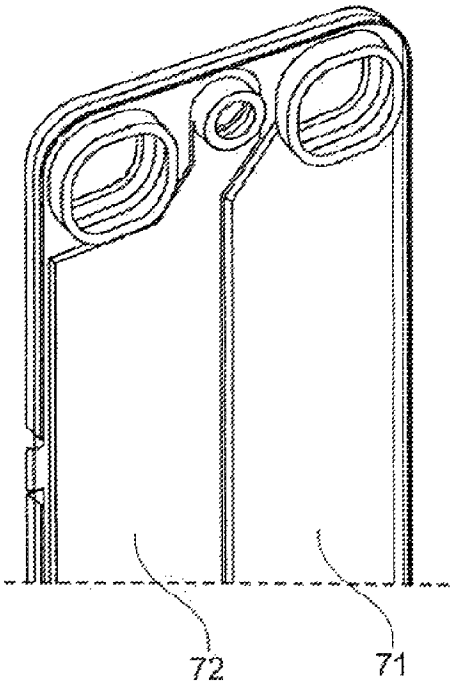
FIG. 9 shows a view of a plate arrangement of a heat exchanger in a detail view.

FIG. 9 then shows the plates, with main plates and attachment plates, which are connected to one another, wherein it can be seen that the attachment plate 72 is connected to the main plate 71. Between FIG. 8 and FIG. 7, a difference can also be seen with regard to the port 84. Said port was not provided in FIG. 7, because, in said figure, the port 85 for the fluid duct 86 was configured with a doubled depth, such that the port 84 was superfluous and it was nevertheless possible for a functional connection of the ports to be realized. If the port 86 is now provided with the same depth as the ports 87 and 88, then it is necessary for the port 84 to be formed with the same depth as the port 86. This configuration uses the advantage that all of the cups of the ports 84, 86, 87 and 88 have the same depth. FIG. 7 is an exemplary embodiment in which the cups 85 have a depth twice that of the other cups, such that the cup 84 provided in FIG. 8 can be omitted.

Figure 11:
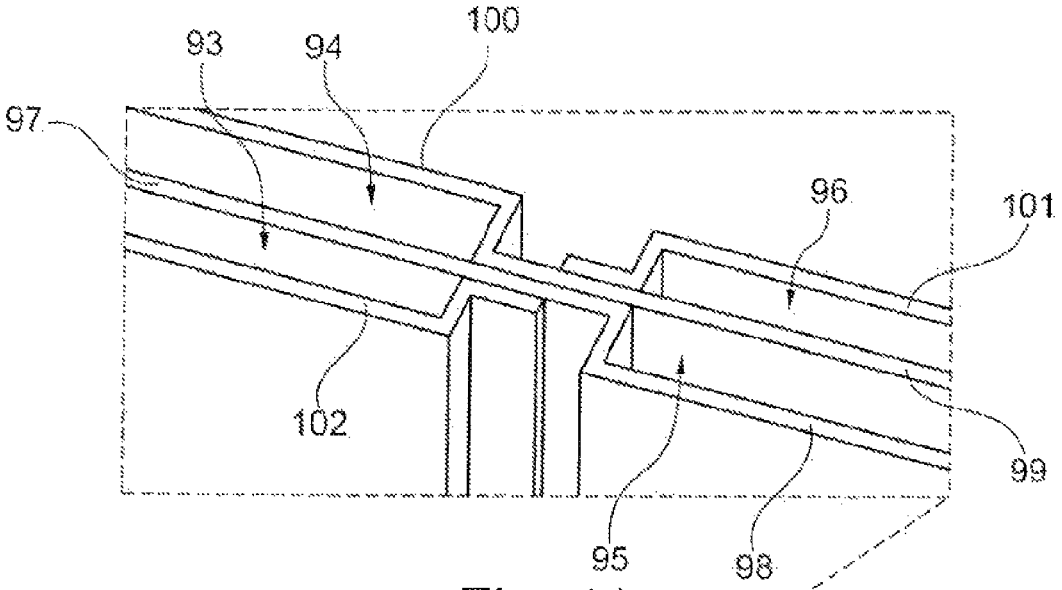
FIG. 11 shows a view of a plate arrangement of a heat exchanger in a sectional illustration.
Figure 10:
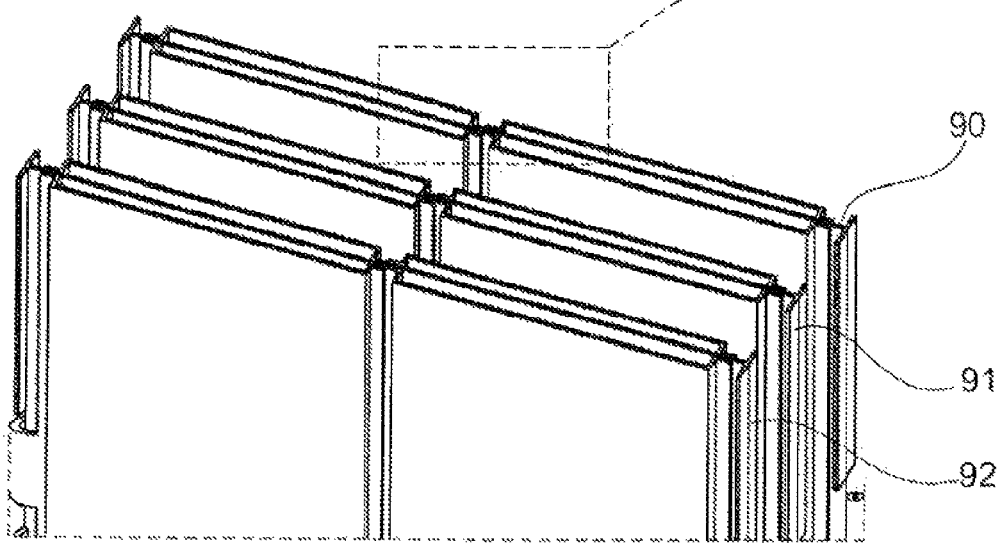
FIG. 10 shows a view of a plate arrangement of a heat exchanger in a sectional illustration.

FIGS. 10 and 11 show a section through a number of plate pairs 90, 91 and 92, wherein the plate pairs each form four separate flow ducts which are produced by virtue of the individual plates and attachment plates being placed onto one another.

FIG. 11 shows a detail from FIG. 10, wherein the four different flow ducts 93, 94, 95 and 96 formed by the respective plates and attachment plates can be seen. Accordingly, the partition 97 and the outer wall 98 are formed by one plate, specifically by the plate 71 in FIG. 7. Furthermore, the partition 99 and the side wall 100 are formed by one plate, specifically the plate 77 in FIG. 7.

In the present exemplary embodiment of FIG. 7 with the elongated rim hole 85 of the plate 72, it can be seen that the cutout 89 in the plate 76 is larger than the diameter of the rim hole 85, such that, when two plate groups 70, 71 and 76, 77 are brazed onto one another, the rim hole 85 comes into contact not with the plate 76 but rather with the plate 71 onto which the plate 72 is brazed from the other side. It is achieved in this way that, in the event of leakage between the brazed plates in the region of the rim hole 85, said leakage occurs only between the outer chamber and the duct between the plates 70 and 71, wherein the other ducts are thereby not involved or compromised.

LIST OF REFERENCE NUMERALS

1 Heat exchanger
2 Collector
3 Collector
4 Block
5 Plate group
6 Space region
7 Port region
8 Port region
9 Port region
10 Flow duct
11 Flow duct
12 Flow duct
13 Attachment plate
14 Plate
20 Plate pair
21 Plate
22 Plate
23 Main plate
24 Attachment plate
25 Main plate
26 Attachment plate
27 Fluid port
28 Fluid port
29 Fluid port
30 Port, cup
31 Port
32 Fluid duct
33 Opening
34 Opening
35 Opening
36 Fluid duct
37 Port region, cup
38 Port region, cup
39 Fluid duct
40 Planar region
41 Region
42 Flow duct
50 Plate
51 Plate
52 Fluid or refrigerant duct
53 Fluid or refrigerant duct
54 Fluid or refrigerant duct
55 Fluid or cold accumulator duct
56 Arrow
57 Arrow
58 Arrow
59 Plate
60 Plate
61 Port
62 Fluid duct
63 Port
64 Port
65 Fluid duct
66 Fluid duct
67 Fluid duct
70 Plate
71 Main plate
72 Attachment plate
73 Fluid duct
74 Port
75 Port
76 Plate
77 Main plate
78 Attachment plate
**78*a*** Attachment plate
79 Fluid duct
80 Port
81 Opening
82 Port
83 Region
84 Port, cup
85 Port, cup
86 Fluid duct
87 Port
88 Port
89 Cutout
90 Plate pair
91 Plate pair
92 Plate pair
93 Flow duct
94 Flow duct
95 Flow duct
96 Flow duct
97 Partition
98 Outer wall
99 Partition
100 Side wall
101 Air direction

The invention claimed is:

1. A heat exchanger comprising:

a plurality of plate pairs arranged in a block, wherein each plate pair comprises a first flow path, a second flow path, a third flow path, and a fourth flow path, wherein each flow path is isolated from the other flow paths, wherein each plate pair comprises at least one first plate and one second plate, wherein the first plate comprises a first main plate and a first attachment plate, wherein the second plate comprises a second main plate and a second attachment plate, wherein a portion of the first flow path and a portion of the second flow path are formed between the first main plate and the second main plate, wherein (a) a portion of the third flow path is formed between the first plate and the second attachment plate and a portion of the first flow path is furthermore formed between the second main plate and the first attachment plate, or (b) a portion of the third flow path is formed between the first main plate and the first attachment plate and a portion of the first flow path is furthermore formed between the second main plate and the second attachment plate, wherein a portion of the fourth flow path is formed between two adjacent plate pairs, wherein the first attachment plate is formed separately from the first main plate is placed onto a planar region of the second main plate such that the first main plate and the first attachment plate abut opposite faces of the second main plate, wherein the second attachment plate is formed separately from the second main plate and is placed onto a planar region of the first main plate such that the second main plate and the second attachment plate abut opposite faces of the first main plate.

2. The heat exchanger as claimed in claim 1, wherein the first main plate and the second main plate and the first attachment plate and the second attachment plate each have openings or cups as port regions and connecting regions, and have duct-forming structures for forming at least one flow path between port regions.

3. The heat exchanger as claimed in claim 1, wherein the first main plate and the second main plate of each plate pair each have three port regions, connecting regions, or some combination thereof at each of two opposite end regions of each main plate, wherein each port or connecting region is connected to one of the first flow path, the second flow path, or the third flow path, wherein at least one duct-forming structure is provided between two opposite port regions to form a portion of the first or the second flow path.

4. The heat exchanger as claimed in claim 1, wherein the first attachment plate and the second attachment plate of each plate pair each two port regions, connecting regions, or some combination thereof at each of two opposite end regions of each attachment plate, wherein each port or connecting region is connected to one of the first flow path, the second flow path, or the third flow path, wherein at least one duct-forming structure is provided between two opposite port regions in order to form a portion of the first or the third flow path.

5. The heat exchanger as claimed in claim 1, wherein the first main plate has a region connected to a first attachment plate, and wherein the second main plate has a region connected to a second attachment plate, wherein the first attachment plate and the second attachment plate have a duct-forming structure between two port regions forming a portion of the first or the third flow path.

6. The heat exchanger as claimed in claim 1, wherein the first main plate, the second main plate, the first attachment plate, and the second attachment plate each comprise duct-forming structures which are embossed into the surface of each plate in the form of a protruding duct.

7. The heat exchanger as claimed in claim 1, wherein the first attachment plate has openings or cups as port regions and connecting regions, wherein the first attachment plate has a duct-forming structure between the port regions forming a portion of the first flow path.

8. The heat exchanger as claimed in claim 1, wherein the second attachment plate has openings or cups as port regions and connecting regions, wherein the second attachment plate has a duct-forming structure between the port regions forming a portion of the second flow path.

* * * * *